United States Patent [19]

Gent et al.

[11] Patent Number: 5,015,504

[45] Date of Patent: May 14, 1991

[54] COATING METHOD FOR FORMING SMOOTH-ENDED BRISTLES ON A BRUSH

[75] Inventors: John A. G. Gent, Liphook; Jacob M. Blass, London, both of England

[73] Assignee: Cogent Limited, London, England

[21] Appl. No.: 487,829

[22] Filed: Mar. 5, 1990

[30] Foreign Application Priority Data

Mar. 10, 1989 [GB] United Kingdom ..... 8905478

[51] Int. Cl.[5] ..... B05D 5/00; B05D 1/18

[52] U.S. Cl. ..... 427/284; 427/387; 427/430.1; 300/21

[58] Field of Search ..... 427/284, 430.1, 387; 15/159 A, 167.1, 167.2; 300/21

[56] References Cited

U.S. PATENT DOCUMENTS

| | | | |
|---|---|---|---|
| 4,118,270 | 10/1978 | Pan et al. | 427/430.1 X |
| 4,263,691 | 4/1981 | Pakarnseree | 15/167.1 X |
| 4,724,569 | 2/1988 | Eguchi et al. | 15/167.1 |
| 4,847,120 | 7/1989 | Gent | 427/387 |

*Primary Examiner*—Evan Lawrence

*Attorney, Agent, or Firm*—Longacre & White

[57] ABSTRACT

The ends of bristles of a brush, e.g. a toothbrush, are treated with a polysiloxane prepolymer which is then cured. The treated bristles are smooth and round-ended.

10 Claims, 1 Drawing Sheet

COATING METHOD FOR FORMING SMOOTH-ENDED BRISTLES ON A BRUSH

FIELD OF THE INVENTION

This invention relates to brushes, especially toothbrushes, and more particularly to the bristles therein. Bristles nowadays are most often made of synthetic materials e.g. nylon, but the term as used here embraces bristles of any material.

DESCRIPTION OF THE PRIOR ART

In most known brushes the bristles have one end mounted in a base, for example of plastic, and the free ends of the bristles are generally cut so as to be substantially square. This is often disadvantageous, since the action of the squared or rough ends can be detrimental to a surface on which the brush is used. For example, damage or wear by scratching or abrasion can occur. This is particularly unwanted in toothbrushes, where the use of square-ended or rough bristles can cause injury to the gums and teeth and other sensitive surfaces in the mouth.

It is known in some brushes to round off the ends of the bristles by a milling process. Though the use of brushes with round-ended bristles avoids much of the damage caused by square ended bristles, the milling process involves several individual milling operations, which can for example be as many as nine. Milling is therefore a time-consuming and expensive procedure and a considerable amount of waste material is produced. Furthermore the ends produced are often, on the microscopic scale, rough.

SUMMARY OF THE INVENTION

It has now been found that this milling process can be dispensed with and brushes having the desired properties can be produced relatively cheaply and quickly, with little waste, by treating the ends of the bristles so as to form a smooth, rounded cap of a polysiloxane polymer at the end of each bristle.

In one aspect of the present invention, a process is provided for forming smooth-ended bristles of a brush, which comprises contacting the free ends of the bristles with a liquid polysiloxane prepolymer composition, removing them from the prepolymer composition with a deposit of prepolymer composition on the free end of each bristle, and curing the prepolymer by evaporation of solvent, thereby forming a body of cured polysiloxane polymer encapsulating the free end of each bristle. The process will usually be carried out when the bristles have all been assembled in the brush. The bristles may be conveniently contacted with the prepolymer composition by dipping them into a bath of the composition to a predetermined depth or by touching the bristles onto a reservoir of the composition, e.g. a foam plastic, sponge or absorbent paper or fabric. It is preferable to maintain the brush with the bristle ends downwards to prevent the escape of composition from the extreme ends of the bristles, and help the formation of globules.

Suitable polysiloxane prepolymer compositions for use in the invention are for example any of those described or claimed in our U.S. Pat. No. 4,847,120 Broadly, a suitable polysiloxane prepolymer composition is an acidic solution of a polysiloxane prepolymer having both non-co-reactive side groups and co-reactive side groups, the co-reactive side groups being additional to siloxane linkage-forming alkoxy, hydroxy or carboxy groups or hydrolysable derivatives thereof, the co-reactive and non-co-reactive groups being liked to respectively different Si atoms. Such a prepolymer is curable by solvent evaporation to cause the formation of further siloxane linkages and also reaction together of the co-reactive groups to cure and cross-link the polymer. The polysiloxane solution may be aqueous throughout the treatment process or alternatively the prepolymer may be formed in an aqueous solution and thereafter an organic solvent substituted for the water solvent so that the solution becomes substantially organic.

In a second aspect of the present invention there are provided brushes having bristles with smooth ends, in which the end of each bristle is encapsulated by a body of a polysiloxane polymer.

DETAILED DESCRIPTION OF THE INVENTION

Figure 1:
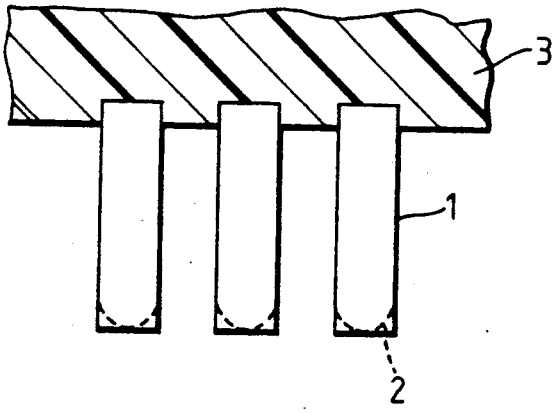
Fig. 1. PRIOR ART
FIG. 1 shows the prior art.

FIG. 1 shows the outline of square cut bristles 1 in a brush, and how they may be rounded (dotted line 2) by milling.

Figure 2:
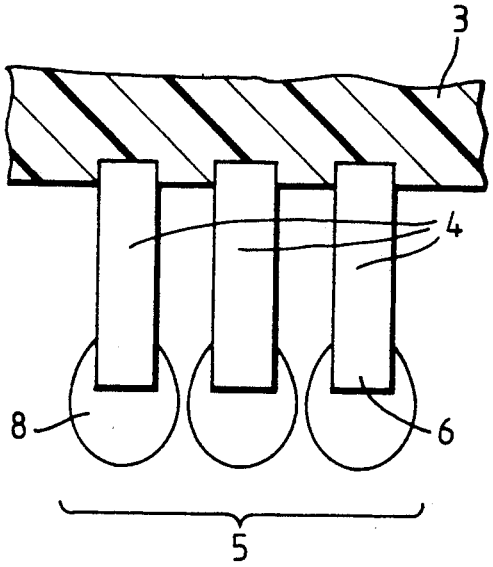
FIG. 2 is a side view of a portion of a brush, on the end of each bristle of which has been deposited a globule of polysiloxane prepolymer composition.

Referring to FIG. 2, a brush comprises a base 3 in which are embedded, in clusters 5, one end of each of a plurality of bristles 4. The base 3 and bristles 4 may be made of any suitable materials, which in the case of toothbrushes are generally a plastics material and a nylon, respectively.

On the free end 6 of each bristle 4 has been deposited a film 8 of a polysiloxane prepolymer composition, such as any of those described or claimed in our U.S. Pat. No. 4,847,120.

The deposition is effected by dipping the bristles of the brush into a bath of the prepolymer composition to a predetermined depth, which will vary according to, for example, the size of the brush and the spacing and width of the bristles. For toothbrushes this depth is typically 2 mm. Alternatively the deposition is made by touching the bristles onto a reservoir of composition such as a foam-plastic, a sponge or an absorbent paper or fabric. The brush is then removed, leaving a film or globule of composition on the end of each bristle.

Figure 3:
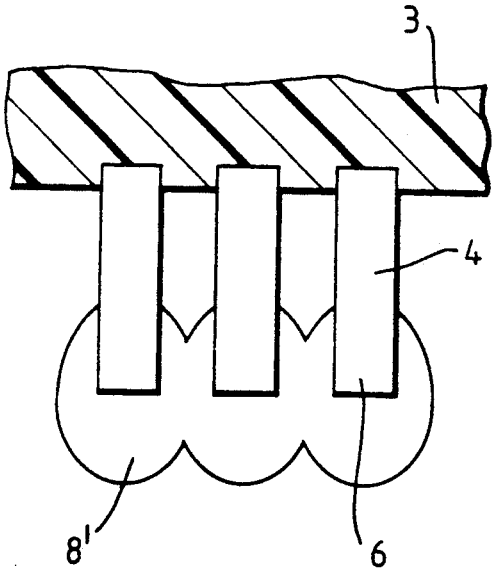
FIG. 3 is a variant of the situation shown in FIG. 2, where the globules on adjacent bristles have partially merged together.

Adjacent films or globules are preferably separate from each other, as shown in FIG. 2. However, it may be possible for adjacent films or globules to merge partially together, as shown in FIG. 3, without substantially affecting the results of the process.

An important factor in determining the formation and appearance of the films is the solid content of the prepolymer composition. It is to be understood that this parameter may be varied experimentally depending upon e.g. the dimensions of the brush and/or the bristles. In general, however, it has been found that for a given brush the solid content should not be too high if the situation shown in FIG. 3 is to be avoided and anything above 20 weight % solid content is likely to be too high. In experiments a lower limit of approximately 1.5 weight % solid content has been found, below which there is insufficient solid material in each film or globule to form, after curing and crosslinking, a body of polysiloxane polymer sufficient to smooth the end of each bristle.

Methods by which the polysiloxane prepolymer composition may be prepared are described in the said earlier applications.

During the curing and crosslinking process, the solvent in the composition evaporates, thus causing each film or globule to decrease in size.

Where, before curing, the situation of FIG. 3 exists, as the solvent evaporates the size of each film will decrease and a point will be reached where the bridges between globules cleave, thus allowing each film to contract as normal with continued evaporation of solvent.

Figure 4:
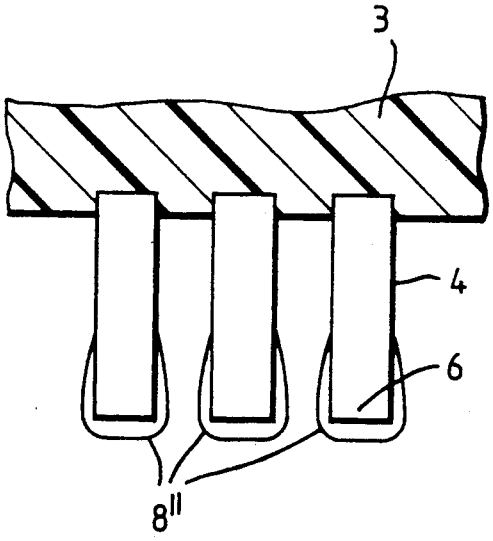
FIG. 4 is a side view of the portion of the brush shown in FIG. 2 after the prepolymer has cured and crosslinked by evaporation of solvent.

As is shown in FIG. 4, after curing and crosslinking, where all the solvent has evaporated, a solid, rounded body of polysiloxane polymer 8' encapsulates the end 6 of each bristle 4 of the brush.

As well as the rounding effect, the encapsulation improves scratch-resistance of the bristle, and also helps to prevent splitting and fraying of the free ends of the bristles. Normally, the cured encapsulation will give a more rounded surface and hence will be effectively softer than the bristle material and therefore less damaging to the tissues.

Furthermore, trials have shown that this comparative softness will mean that, in the presence of highly abrasive medium such as toothpaste, the encapsulation may wear off, especially that portion of it which is beyond the free end of the bristles as distinct from lying between the bristles. However, this is no disadvantage since the progressive nature of the wear means that as sharp corners of the bristles are fist exposed they are subjected to wear; by the time that the encapsulation has worn away the bristle itself has become sufficiently rounded.

The progressive wear of the encapsulation means that it may be used as a vehicle for oral dental or gingival medicaments e.g. Hexetidine, Chlorhexidine; Cetyl pyridium chloride; Triclosan (Ciba-Geigy) with or without Gantrez; Sodium, Ammonium or Stannous Fluorides; Strontium Chloride; Potassium salts such as the bicarbonate or sulphate. Wear of the polymer then gives a sustained-release effect in the mouth of the user.

We claim:

1. A process for treating bristles of a brush having a base and bristles, the bristles having two ends, one of said ends being anchored in said base, the other of said ends being a free end, comprising the steps of:

(i) contacting the free ends of the bristles with a composition of a polysiloxane prepolymer in solution in a solvent, (ii) removing the bristles from the prepolymer composition to deposit prepolymer composition on the end of each bristle, and (iii) curing each deposit of polysiloxane prepolymer by evaporation of the solvent, so as to form a body of cured polysiloxane polymer encapsulating the free end of each bristle, wherein the prepolymer composition has a solids content such that after step (iii) the free end of each bristle is substantially individually encapsulated by a smooth, rounded cap of cured polysiloxane polymer.

2. A process according to claim 1, wherein the prepolymer composition is an acidic solution of a polysiloxane prepolymer having both non-co-reactive side groups and co-reactive side groups, the co-reactive side groups being additional to siloxane linkage-forming alkoxy, hydroxy or carboxy groups or hydrolysable derivatives thereof, the co-reactive and non-co-reactive groups being linked to respectively different Si atoms, the prepolymer being curable by solvent evaporation to cause the formation of further siloxane linkages and also reaction together of the co-reactive groups to cure and cross-link the polymer.

3.. A process according to claim 2, wherein the solution is substantially aqueous throughout the process.

4. A process according to claim 2, wherein the prepolymer is formed in an aqueous solution and prior to step (i) an organic solvent is substituted for the water solvent, whereby the solution becomes substantially organic.

5. A process according to claim 1, wherein the brush is a toothbrush.

6. A process according to claim 1, wherein the bristles are of a nylon.

7. A process according to claim 1, wherein the ends of the bristles are contacted with the prepolymer composition by:

(a) dipping the free ends into a volume of the composition to a predetermined depth, or (b) touching the bristles onto a reservoir of the composition.

8. A process according to claim 1, wherein after depositing and at least until the prepolymer has cured the bristles are maintained with their free ends downwardly.

9. A process according to claim 1, wherein before the curing step (iii) the deposits of prepolymer on the ends of adjacent bristles partially merge with each other, but after curing are substantially all separate from each other.

10. A process according to claim 1, wherein the solids content of the prepolymer composition is in the range of about 1.5 to 20 weight percent.

* * * * *